US007858017B2

(12) United States Patent
Minamimura et al.

(10) Patent No.: US 7,858,017 B2
(45) Date of Patent: Dec. 28, 2010

(54) MATERIAL MELTING AND HOLDING APPARATUS OF METAL MOLDING APPARATUS AND ROD MATERIAL MELTING METHOD

(75) Inventors: Masaaki Minamimura, Nagano-ken (JP); Yasuhiko Takeuchi, Nagano-ken (JP); Toshiyasu Koda, Nagano-ken (JP); Mamoru Miyagawa, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 567 days.

(21) Appl. No.: 12/002,356

(22) Filed: Dec. 17, 2007

(65) Prior Publication Data

US 2008/0143025 A1 Jun. 19, 2008

(30) Foreign Application Priority Data

Dec. 18, 2006 (JP) ..... 2006-340091

(51) Int. Cl.
*B22D 41/01* (2006.01)

(52) U.S. Cl. ..... 266/45; 164/312; 164/113

(58) Field of Classification Search ..... 266/45, 266/236; 164/312, 113
See application file for complete search history.

(56) References Cited

U.S. PATENT DOCUMENTS 7,137,435 B2 * 11/2006 Fujikawa ..... 164/312
7,331,372 B2 * 2/2008 Takizawa et al. ..... 164/113

FOREIGN PATENT DOCUMENTS

| | | |
|---|---|---|
| JP | 2004-291032 | 10/2004 |
| JP | 2005-040807 | 2/2005 |
| JP | 2006-000809 | 1/2006 |

* cited by examiner

*Primary Examiner*—Scott Kastler
(74) *Attorney, Agent, or Firm*—Weingarten, Schurgin, Gagnebin & Lebovici LLP

(57) ABSTRACT

There is provided a method for melting a material rod in a material melting and holding apparatus of a metal molding apparatus where the material melting and holding apparatus provided for the metal molding apparatus includes a furnace body of a melting and holding furnace, and a melting cylinder for a material rod and a material supply cylinder for directly supplying the material rod into the furnace body provided in parallel with each other on the furnace body, upon startup of molding, the material rod is melted using the melting cylinder prior to supplying the molten material from the melting cylinder into the melting and holding furnace, and the material rod subsequently supplied from the material supply cylinder to a bottom portion of the furnace body is submerged and melted by the molten material, thereby maintaining the submersion melting in the melting and holding furnace after the startup of molding.

4 Claims, 4 Drawing Sheets

MATERIAL MELTING AND HOLDING APPARATUS OF METAL MOLDING APPARATUS AND ROD MATERIAL MELTING METHOD

This application claims priority to Japanese application No. 2006-340091 filed Dec. 18, 2006.

BACKGROUND OF THE INVENTION

1. Field of the Invention

The present invention relates to a method for melting a rod material such as magnesium and aluminum in a material melting and holding apparatus of a metal molding apparatus.

2. Description of the Prior Art

As an injection apparatus for metal molding, Japanese Laid-Open Patent Publication No. 2004-291032 discloses an apparatus having such a structure that a melting furnace is provided on an injection cylinder internally containing a plunger, a solid material is melted by the melting furnace, the molten material is reserved in the melting furnace, the molten material in the melting furnace is sucked and accumulated in a material measurement chamber in front of the plunger formed by a backward travel of the plunger for measurement of the molten material in a quantity of one shot, and the measured material is injected from a nozzle at a tip of the cylinder into a mold by a forward travel of the plunger.

Moreover, as an injection apparatus for metal molding using a material rod as a material for molding, Japanese Laid-Open Patent Publication No. 2005-40807 discloses an apparatus having such a structure that a heat holding reserve cylinder is erected in a solution retaining chamber of an injecting and heating cylinder internally containing an injection plunger, a melting apparatus provided with a heating cylinder extending in the widthwise direction is provided on the top side of the heat retaining reserve cylinder, material rods are melted by the heating cylinder, the molten material is held in a quantity corresponding to multiple shots in the heat retaining reserve cylinder, the molten material in the solution retaining chamber is sucked and accumulated in a material measurement chamber in front of the injection plunger formed by a backward travel of the plunger for measurement of the molten material in a quantity of one shot, and the measured material is injected from a nozzle at a tip of the cylinder into a mold by a forward travel of the plunger.

Moreover, Japanese Laid-Open Patent Publication No. 2006-809 discloses an apparatus having such a structure that a melting cylinder for rod materials is erected on heating and holding cylinder internally containing an injection plunger, the material rods are melted by the melting cylinder, the molten material is reserved in a quantity corresponding to multiple shots in the heating and holding cylinder, the molten material in the heating and holding cylinder is sucked and accumulated in a material measurement chamber in front of the injection plunger formed by a backward travel of the plunger for measurement of the molten material, and the measured material is injected from a nozzle at a tip of the cylinder into a mold by a forward travel of the plunger.

In the conventional apparatus which melts the solid material in the melting furnace, reserves the molten material, measures the molten material in a quantity of one shot for each backward travel of the plunger, and injects the measured material, the solid material supplied is submerged and melted by the molten material which has already melted in the melting furnace. Thus, if a molten material is present in the melting furnace, even a material rod is melted in a short period. However, if no molten material is present in the melting furnace upon startup of molding, the material rods supplied into a furnace body are melted by radiant heat from a periphery and a bottom portion of the furnace body, which is less efficient in heating than the submersion melting, and it takes a long period until multiple material rods are melted, and the molten material thus reaches a reserved quantity sufficient for submersing and melting the material rods. As a result, if the rod materials are melted by the melting furnace, the startup of the molding takes as long as 60 minutes, and there poses a problem of inefficient molding operation.

Moreover, when the material is melted by the melting furnace, the temperature of the supplied material is lower than the molten material, so the temperature of the molten material around the solid material decreases each time the material is supplied, thus, in order to prevent this temperature fluctuation from affecting the molten material supplied to the injection cylinder, the material rods are heated in advance at other location thereby decreasing the difference in temperature from the molten material, and then bringing and supplying the material to and into the melting furnace, which is inconvenient.

In the melting method of storing and melting material rods in the melting cylinder, though the material is melted by the radiant heat, which is less efficient in melting than the submersion melting, the entire material receives the ambient radiant heat, the heating efficiency is significantly high, the melting can be maintained by simply inserting material rods into the melting cylinder, the molten material can be reserved and held in a heat retaining reserve cylinder of a injecting and heating cylinder or a heating and holding cylinder, so the molding startup period can be approximately 20 minutes, and the molding operation can start earlier than a case in which the material rods are melted directly by the melting furnace. Moreover, this method has an advantage that the temperature drop due to the material supply does not happen in the melting furnace. However, the quantity of the material reserved after melting is restricted, melting and supplying a material adapted to a molding cycle may thus be difficult depending on the weight of a metal product, and this method has a problem that it is hardly applicable to a large machine.

SUMMARY OF THE INVENTION

The present invention is devised in view of the foregoing problems of the conventional material melting, and has an object to provide a new melting and holding method for material rods in a material melting and holding apparatus of a metal molding apparatus which employs a melting cylinder for melting material rods and submersion melting by a molten material in a furnace body, transitions from the material melting by the melting cylinder upon startup of molding to the material melting by means of the submersion melting after the startup, can increase the efficiency of the melting compared with the conventional method, and can secure a sufficient quantity of the reserve.

To attain the above object, the present invention provides a method for melting material rods in a material melting and holding apparatus of a metal molding apparatus where the material melting and holding apparatus provided for the metal molding apparatus comprises a furnace body of a melting and holding furnace, and a melting cylinder for material rods and a material supply cylinder for directly supplying the material rods into the furnace body provided in parallel with each other on the furnace body, upon startup of molding, the material rods are melted using the melting cylinder prior to supplying the molten material from the melting cylinder into the melting and holding furnace, and the material rods subsequently supplied from the material supply cylinder to a bottom portion of the furnace body are submerged and melted by the molten material, thereby maintaining the submersion melting in the melting and holding furnace after the startup of molding.

Moreover, the material rods are supplied to the melting cylinder and the material supply cylinder on the startup of molding, after a molten surface of the molten material in the melting and holding furnace reaches a level sufficient for the submersion melting of the material rods supplied from the material supply cylinder, the melting cylinder stops melting the material rods, and the material supply is continued while the material rods are pre-heated by the material supply cylinder.

Moreover, the material rods are supplied to the melting cylinder first, and the material rods are supplied to the material supply cylinder after a molten surface of the molten material in the melting and holding furnace reaches a level sufficient for the submersion melting of the material rods supplied from the material supply cylinder, and the material supply is continued while the material rods are pre-heated by the material supply cylinder, and, further, the melting of the material rods by the melting cylinder and the submersion melting of the material rods by the molten material in the melting and holding furnace are carried out at the same time.

EFFECTS OF THE INVENTION

With the above configuration, since the material rods are melted by the melting cylinder to be the molten material, and the molten material is supplied to the melting and holding furnace, the molten material held in the melting and holding furnace, upon the startup of molding, reaches a specified quantity faster than a case where the material rods are directly melted by the furnace body, resulting in faster startup of molding.

Moreover, after the molten surface of the molten material reaches the specified level, since the material rods inserted and supplied from the material supply cylinder to the melting and holding furnace is melted by the submersion melting with the molten material, the material can be melted and held in response to the molding cycle after the startup of molding, the material rod does not submerge entirely in the molten material in the submersion melting, but the material rod starts melting at a location which is submerged in the molten material, and the decrease of the temperature of the molten material due to the supplied material rod is only local. Further, if the material rod is pre-heated, since the difference in temperature from the molten material is small, the decrease of the temperature soon disappears, the entire molten material is thus not influenced, and the temperature of the molten material supplied from the material melting and holding apparatus to the metal molding apparatus is always stable.

BRIEF DESCRIPTION OF THE DRAWINGS

FIGS. 4A and 4B describes the material melting and holding method in which:

FIG. 4A describes this method upon startup of molding; and

FIG. 4B describes this method during molding operation.

DESCRIPTION OF THE PREFERRED EMBODIMENT

Figure 1:
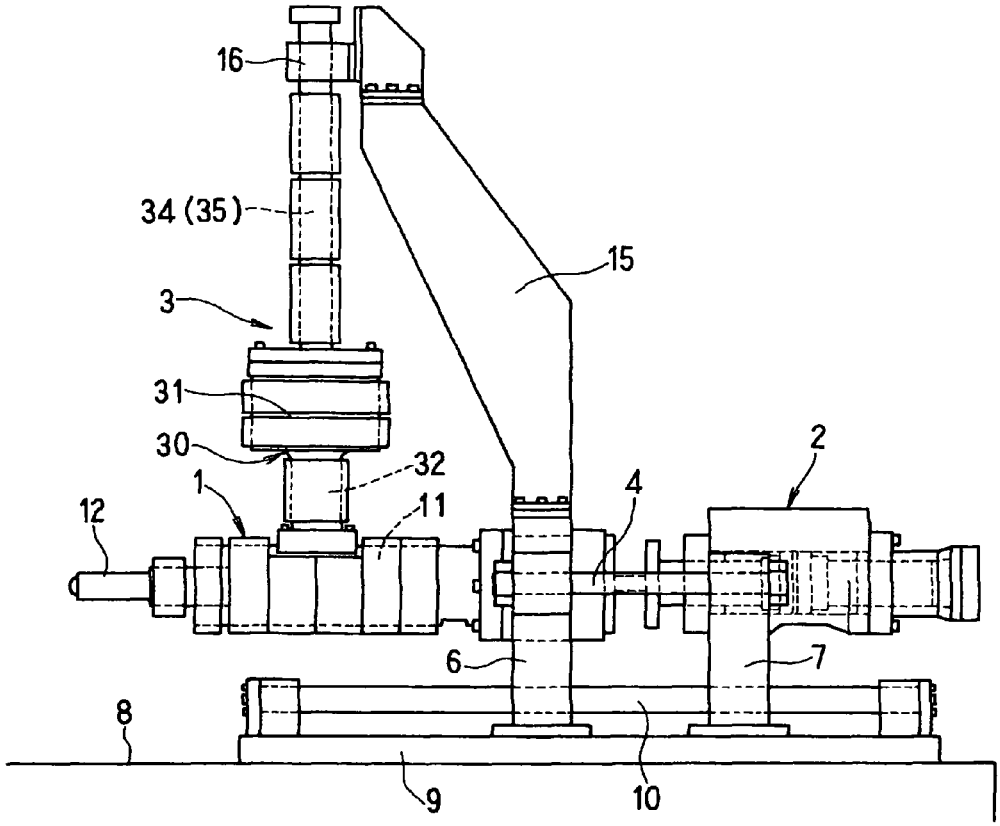
FIG. 1 is a side view of a metal molding apparatus provided with a material melting and holding apparatus which can carry out a method for melting and holding material rods according to the present invention.
Figure 2:
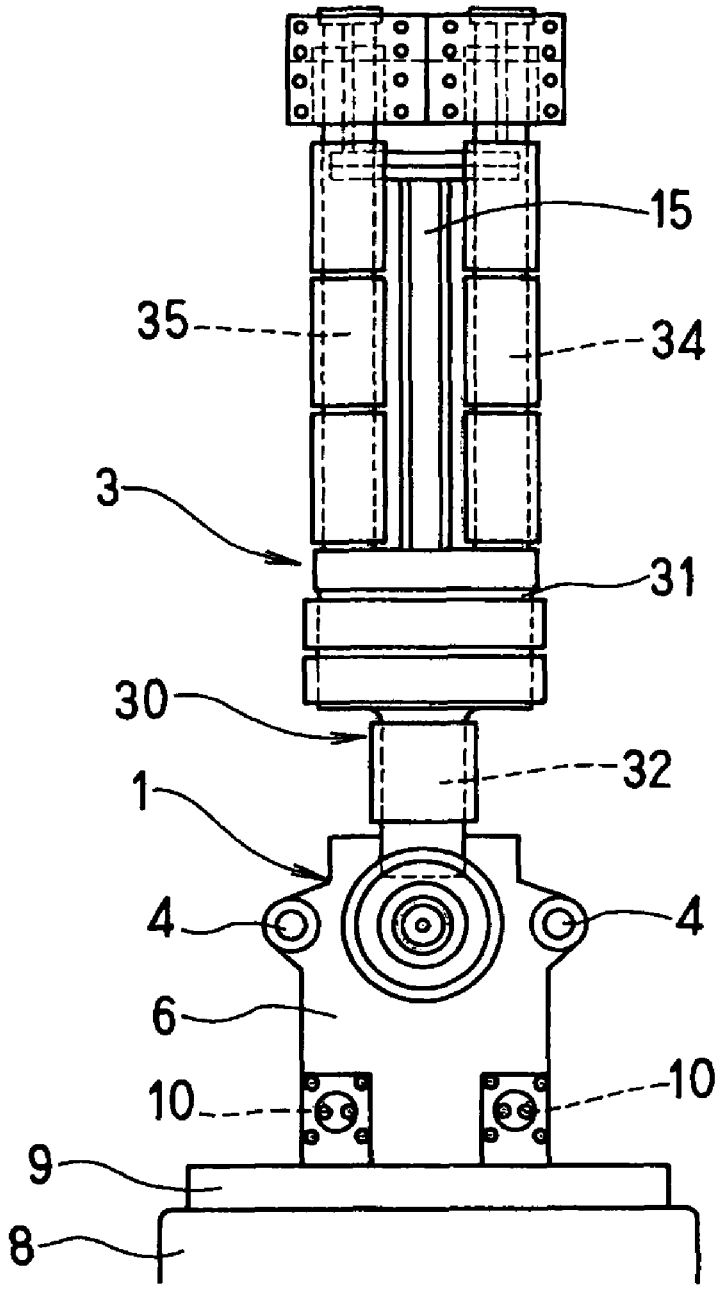
FIG. 2 is a front view of the metal molding apparatus.

Throughout the drawings, reference numeral 1 denotes an injection cylinder of a metal molding apparatus of injection type; 2, an injection drive apparatus provided at and separated from a rear end of the injection cylinder 1; and 3, a material melting and holding apparatus provided above a front portion of the injection cylinder 1. The injection cylinder 1 and the injection drive apparatus 2 are connected with each other by rods 4 respectively provided on the both sides, and both of them are horizontally provided on an machine base 8 by inserting front and rear supports 6 and 7 integrally formed with the injection cylinder 1 and the injection drive apparatus 2 respectively into a pair of parallel left and right support shafts 10 provided horizontally on a seat plate 9 of the machine base 8.

Figure 3:
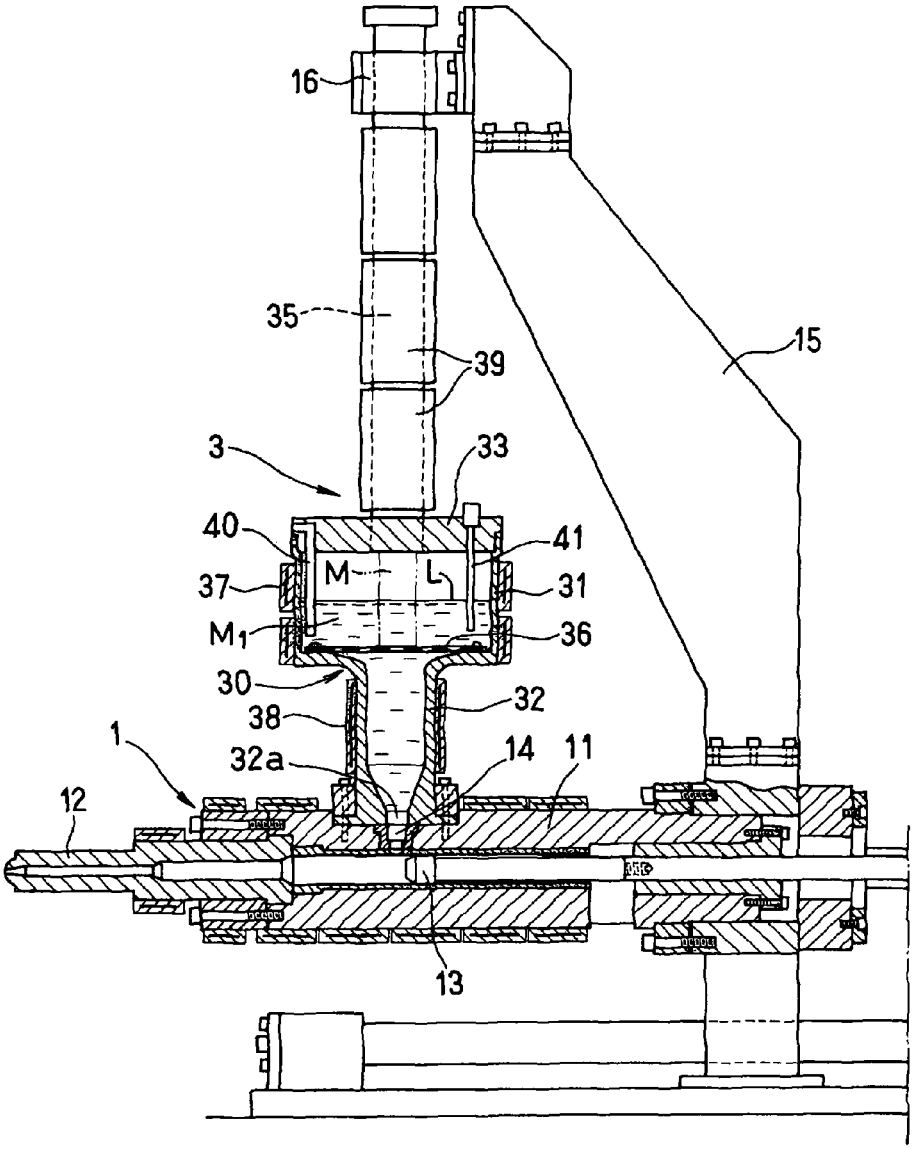
FIG. 3 is a longitudinal side cross sectional view of the material melting and holding apparatus and an injection cylinder.

The injection cylinder 1 has a standard structure in which an injection plunger 13 is provided for moving forward and backward freely at the center inside of a cylinder main unit 11 including a nozzle 12 at an end, and a supply opening 14 is provided at a top portion of a retracted position of the injection plunger 13 as shown in FIG. 3, and the material melting and holding apparatus 3 is provided at the supply opening 14 on the cylinder main unit 11 while the material melting and holding apparatus 3 is supported by a stand 15 erected on a rear portion of the cylinder main unit 11.

The material melting and holding apparatus 3 includes a melting and holding furnace 30 constructed by a furnace body 31 which is circular in a plan view, and has a height inside a furnace shorter than the length of the material rods, and a reserve cylinder 32 which has a body portion integrally formed downward from a circular bottom surface of the furnace body 31 at the center of the bottom surface, has a bottom inner wall formed as a sloped surface by gradually reducing the diameter down to a flow outlet 32*a* located at the center of a bottom end, and holds a molten material, and a material melting cylinder 34 and a material supply cylinder 35 which have bottom ends inserted into and engaged with respective holes provided through a lid member 33, and are formed by cylindrical bodies which are arranged in parallel to each other on a top of the furnace body 31, are the same in length, and are long in the vertical direction.

A perforated plate 36, which is interposed between the inside of the furnace body 31 and the reserve cylinder 32 so as to restrict the quantity of impurities such as sludge sedimenting from the furnace body 31 into the reserve cylinder 32, is provided on and covers a bottom portion of the furnace body 31. The perforated plate 36 is not necessary, and is thus not used if the molten material is partially melted, and the impurities hardly sediment. Moreover, heating means 37, 38, and 39 constituted by multiple band heaters are attached on outer peripheries of the furnace body 31, the body portion of the reserve cylinder 32, the material melting cylinders 34, and the material supply cylinder 35.

Figure 4:
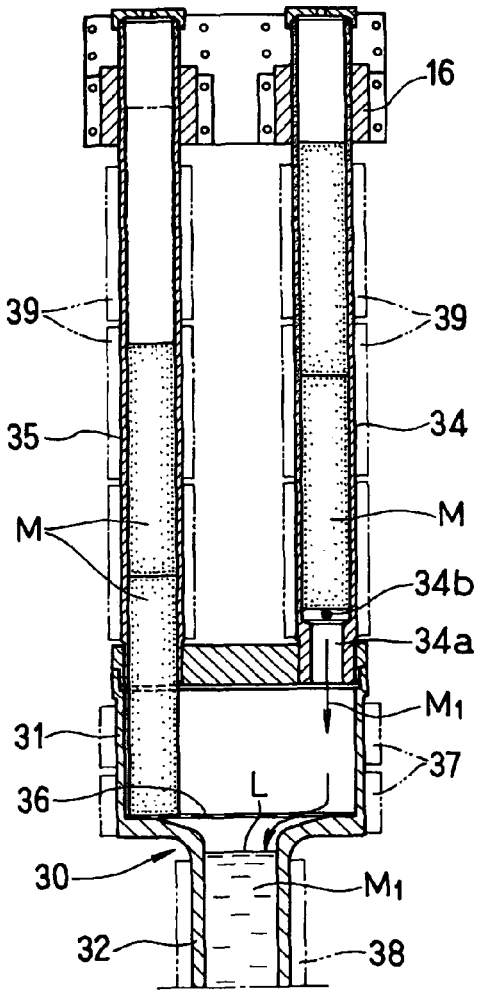
Figure 4:
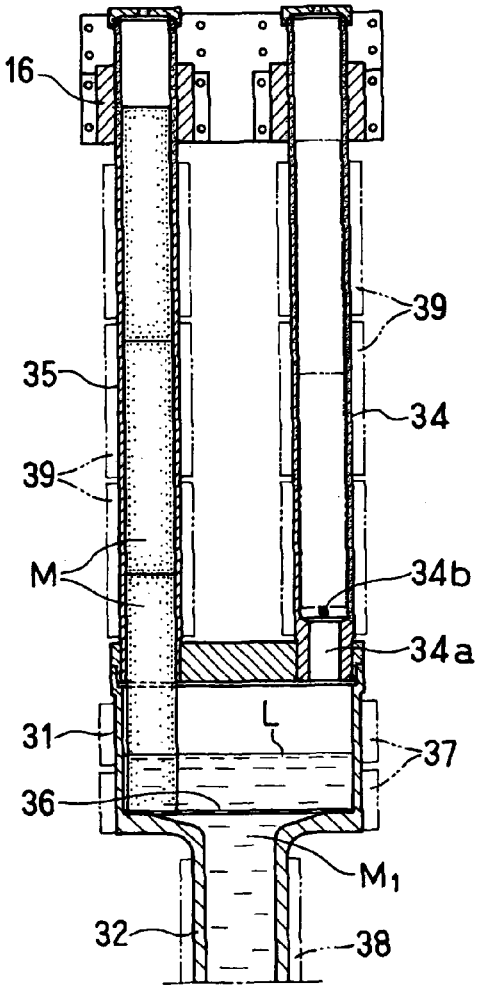

The melting cylinder 34 and the material supply cylinder 35 have a cylindrical body having a length and a diameter which can store at least two material rods M of a standard dimensions (300 mm in length, 60 mm in diameter, and approximately twelve (12) minutes of melting period for magnesium base alloy, for example) as shown in FIG. 4. In the melting cylinder 34, the diameter of a bottom end opening 34*a* is reduced to form a step portion on a periphery of the opening, and a material support shaft 34*b* is horizontally provided in a lower portion close to the opening, thereby providing a function of holding the material rods M in the cylinder, heating the material rods M using the radiant heat from the heating means 39 on the periphery of the cylindrical body, and supplying the material in a melted or partially melted state into the furnace body 31.

Moreover, the material supply cylinder 35 is opened in the furnace body 31 without reducing the diameter of a bottom end opening so that the material rods M can be inserted thorough the lid member 33 until the bottom surface of the furnace body 31 come to support the material rods M, and functions as a pre-heating cylinder for the material rods M using the heating means 39 around the cylindrical body.

The material melting and holding apparatus 3 is provided vertically with respect to the injection cylinder 1 by providing a bottom end of the reserve cylinder 32 on the cylinder body 11 provided with the supply opening 14, abutting the flow outlet 32*a* on top of the supply opening 14, and supporting upper portions of the melting cylinder 34 and the material supply cylinder 35 at a top end portion of the stand 15 through a member 16 permitting an extension of the cylindrical bodies due to thermal expansion.

Though the material melting and holding apparatus 3 is provided on the injection cylinder 1 of the metal molding apparatus of injection type in the illustrated example, the metal molding apparatus may be a cold chamber die casting machine, and the material melting and holding apparatus 3 is provided on an inlet opening of a sleeve internally containing a plunger in this case.

A description will now be given of the material melting upon start of molding in the material melting and holding apparatus 3 with reference to FIG. 4.

First, the furnace body 1, the reserve cylinder 32, and the melting cylinder 34 are heated to a specified temperature by the heating means 37, 38, and 39. If the metal material is magnesium base alloy (AZ91D), the specified temperature is 600° C. to 650° C. for fully melting, and 570° C. to 585° C. for partially melting. Moreover, the material supply cylinder 35 is set to 500° C. to 595° C. by the heating means 39 for the pre-heating. The material supply cylinder 35 may be set to 600° C. to 650° C. to be used as a melting cylinder.

Then, an inert gas such as argon is introduced from a gas introduction pipe 41 provided on a top portion of the furnace body 31 to form an inert gas atmosphere inside the furnace body 31, the melting cylinder 34, and the material supply cylinder 35. Before or after the internal temperature reaches the specified temperature, or possibly before the heating, the material rods M are supplied into the cylinders from the openings at the top end of both the melting cylinder 34 and the material supply cylinder 35. The openings are closed by the perforated lids after the material rods M are supplied.

The two material rods M stored in the melting cylinder 34 is melted into a fully melted state or a partially melted state in the cylinder by the heating means 39, and flows out as a molten material $M_1$ from the bottom end opening 34*a* into the melting and holding furnace 30 as shown in FIG. 4A. The supply of the molten material $M_1$ from the melting cylinder 34 continues while the material rods M are additionally supplied until a molten surface L reaches a specified level. The specified level is detected by a level detection rod 41 provided inside a top portion of the furnace body 31.

When the material is melted by the melting cylinder 34, since a gap between the cylindrical body and the periphery of the material rods M is small, and the entire circumference of the material rods M are heated by the radiant heat, the heating efficiency is high, even if two material rods M are melted in the cylinder, and are then supplied to the melting and holding furnace 30, the efficiency is higher than a case in which multiple similar material rods are supplied and melted at once in a vacant furnace body, and the reserved molten material $M_1$ reaches the specified level earlier in the melting and holding furnace 30. As a result, the period required for starting up molding is reduced, and the transition to the molding operation takes place earlier.

The supply of the material rods M into the melting cylinder 34 is stopped when there arises a state in which the material rods M in the material supply cylinder 35 can be submerged, heated, and melted in the molten material $M_1$ as shown in FIG. 4B, and the heating by the melting cylinder 34 stops after all the material rods M in the cylinder are melted and flow out. Subsequently the material rods M are supplied into the melting and holding furnace only from the material supply cylinder 35, and the melting of the material is carried out only as the submersion melting by the molten material $M_1$ held in the melting and holding furnace 30.

In the material supply cylinder 35, the lower material rods M stored in the cylinder are inserted into the furnace body 31 from the lower end opening 35*a* until the bottom portions of the material rods M come to be supported by the circular bottom surface of the furnace body 31. Since the material rods M are pre-heated by the heating means 39 in the cylinder, it is possible to save labor for pre-heating the material rods M at other location. In the furnace body 31, the material rods M are heated by the heating means 37 until the material rods M are submerged in the molten material $M_1$, and after the molten surface L has risen, the material rod M is heated by the molten material $M_1$ after the submersion, and starts melting at the submerged location. As a result, a material melted in the melted cylinder 34 can be used to address fluctuation of the molten surface L in the melting and holding furnace 30.

A temporary decrease in temperature of the molten material $M_1$ due to the submersion of the material rod M is immediately recovered since the difference in temperature between the material rod M pre-heated in the cylinder and the molten material $M_1$ is smaller than a case in which the material rod M is not pre-heated, and since the submersion melting occurs at the submerged location in the furnace body 31, the influence thereof is not exerted on the molten material at a lower portion in the reserve cylinder 32. As a result, the temperature of the molten material supplied to the injection cylinder 1 does not fluctuate, and the stable temperature of the material is always maintained.

If the molten surface L of the molten material $M_1$ drops close to a limit of a permissible range of the specified level, the material rods M are supplied to the material supply cylinder 35, the material rods M are submerged and melted, the held quantity increases, the level of the molten surface L is maintained within the permissible range, and the specified temperature is maintained. Moreover, if the molten surface L of the molten material $M_1$ drops below the permissible level, and reaches a limit of the submersion melting, the melting of the material by the melting cylinder 34, which has been stopped, starts, the material is supplied, and the molten material $M_1$ is supplied from the melting cylinder 34 into the furnace body 31, and the molten surface L rises to the specified level. As a result, the submersion melting of the material rods $M_1$ from the material supply cylinder 35 may be continued.

Though the material is melted by supplying the material rods M into both the melting cylinder 34 and the material supply cylinder 35 as mentioned above, since the melting of the material rods M from the material supply cylinder 35 is carried out as the submersion melting in the furnace body 31, the material rods M may not be supplied to the material supply cylinder 35 simultaneously when the material rods M are supplied to the melting cylinder 34, and may be supplied to the material supply cylinder 35 when the molten surface L of the molten material $M_1$ reaches the level sufficient for submerging the material rods M, which hardly delays subsequent submersion melting, and hardly causes the quantity of the molten material $M_1$ held in the melting and holding furnace 30 to decrease.

What is claimed is:

1. A method for melting a material in rod form in a material melting and holding apparatus of a metal molding apparatus, the material melting and holding apparatus comprising a furnace body of a melting and holding furnace, a melting cylinder for one or more rods of material and a material supply cylinder for directly supplying one or more rods of material into the furnace body;

the melting and supply cylinders being provided in parallel with each other on the furnace body;

said method comprising:

initiating molding by melting one or more rods of material in the melting cylinder;

supplying molten material from the melting cylinder into the melting and holding furnace;

supplying one or more rods of material thereafter from the material supply cylinder to a bottom portion of the furnace body for submergence and melting by the molten material in the melting and holding furnace;

thereby maintaining the submersion melting in the melting and holding furnace after the initiation of molding.

2. The method according to claim 1 wherein the rod material is supplied to the melting cylinder and the material supply cylinder on the initiation of molding;

after a molten surface of the molten material in the melting and holding furnace reaches a level sufficient for the submersion melting of the rod material supplied from the material supply cylinder, stopping the melting of rod material in the melting cylinder; and continuing the rod material supply from the supply cylinder while pre-heating the material supply cylinder.

3. The method according to claim 1 wherein:

the rod material is supplied to the melting cylinder first;

the rod material is supplied to the material supply cylinder after a molten surface of the molten material in the melting and holding furnace reaches a level sufficient for the submersion melting of the rod material supplied from the material supply cylinder; and continuing the rod material supply from the supply cylinder while pre-heating the material supply cylinder.

4. The method according to claim 1 wherein the melting of the rod material by the melting cylinder and the submersion melting of the rod material by the molten material in the melting and holding furnace are carried out at the same time.

* * * * *